United States Patent [19]

Hasegawa

[11] 4,165,017

[45] Aug. 21, 1979

[54] CHILD RESISTANT PULL TAB

[75] Inventor: Gary K. Hasegawa, Chicago, Ill.

[73] Assignee: The Continental Group, Inc., New York, N.Y.

[21] Appl. No.: 947,297

[22] Filed: Sep. 29, 1978

[51] Int. Cl.[2] ..... B65D 41/32

[52] U.S. Cl. ..... 220/273

[58] Field of Search ..... 220/269–274

[56] References Cited

U.S. PATENT DOCUMENTS

| | | | |
|---|---|---|---|
| 3,307,737 | 3/1967 | Harvey et al. | 220/271 |
| 3,499,573 | 3/1970 | Adams | 220/271 |
| 3,986,631 | 10/1976 | Ostrem | 220/270 |

*Primary Examiner*—George T. Hall

*Attorney, Agent, or Firm*—Charles E. Brown

[57] ABSTRACT

A child resistant pull tab arrangement wherein the pull tab is provided with an upstanding peripheral hem which on the side of the rivet remote from the nose portion of the tab is configurated so as to touch or substantially touch the container wall in the initial position thereof so as to resist lifting by a small child. The tab may have associated with it an upstanding rib formed in the container wall, the rib extends about the lift portion of the tab in closely adjacent relation and makes it even more difficult to engage one's finger beneath the tab so as to effect the required initial lifting.

8 Claims, 14 Drawing Figures

CHILD RESISTANT PULL TAB

This invention relates in general to new and useful improvements in pull tabs for easy opening containers, and more particularly to a pull tab which is resistant to actuation by children of predetermined ages.

It might be said that easy opening containers, particularly those having pull tabs, are attractive nuisances as far as many small children are concerned in that they appear to have great enjoyment in untimely opening such containers. Accordingly, it is proposed to provide a lift or pull tab for easy opening containers of a construction wherein it is more difficult than normal to engage one's finger beneath the pull tab to effect actuation thereof.

In accordance with this invention it is first of all proposed to provide a pull tab with a peripheral hem extending at least about the lift portion of the tab and wherein the peripheral hem is of a configuration such that it closely engages the container panel to which the tab is secured, whereby insertion of one's finger beneath the lift portion of the tab is difficult and requires certain strength which is normally beyond the capability of small children Another feature of the invention is the formation of the associated container panel so as to provide an upstanding rib which extends around in close relation to the periphery of the lift portion of the tab so as further to make it more difficult for one who does not know how to overcome the situation to initiate lifting of the tab so that the tab may be actuated.

Most particularly, the peripheral hem of the tab is formed so as to be in upstanding relation whereby the tab body may be tightly clamped against a container wall and the outer edge of the hem in a like manner disposed either in engagement with or closely adjacent to the container wall.

With the associated container wall provided with a cooperating rib, the rib and the pull tab hem present adjacent upstanding walls which make it very difficult for one to insert a finger into the necessary portion to effect initial lifting of the tab whereby the tab may be lifted to such an extent so as to effect opening of an associated container panel.

With the above and other objects in view that will hereinafter appear, the nature of the invention will be more clearly understood by reference to the following detailed description, the appended claims, and the several views illustrated in the accompanying drawings.

Figure 1:
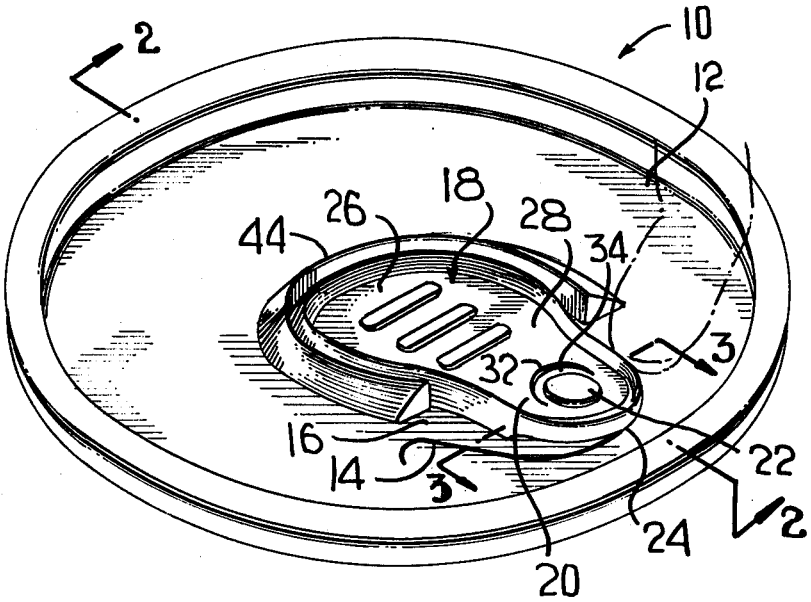
FIG. 1 is a perspective view of an easy opening end unit provided with the child resistant pull tab assembly.

Referring now to the drawings in detail, it will be seen that the invention is illustrated in its preferred environment, i.e., in conjunction with an end unit for a can, the end unit being generally identified by the numeral 10. The end unit 10 includes a container wall 12 in the form of an end panel. The container wall 12 is provided with a score line 14 of a selected configuration which facilitates the rupture of the container wall and is of a configuration to define a displaceable panel portion 16 which is particularly configurated to provide for the desired dispensing opening.

In order that the container wall 12 may be ruptured along the score line 14 and the displaceable panel portion displaced, there is provided a pull tab, generally identified by the numeral 18. The pull tab 18 includes an intermediate securing portion 20 through which a rivet 22, preferably integrally formed with the container wall 12, passes. The front part of the tab 18 is in the form of a nose portion 24 through which an opening force is applied on the container wall 12 along a central portion of the score line 14.

The rear part of the tab 18 is in the form of a lift portion 26. The lift portion 26 is configurated and proportioned relative to the securing portion 20 and the nose portion 24 so as to facilitate the rupture of the container wall 12 along the score line 14 when the lift portion is lifted.

The specific details of the score configuration, the displaceable panel configuration and the mounting of the pull tab are not part of this invention and may be varied in accordance with the opening requirements of the particular container. The illustrated pull tab 18 does, however, have a flat or generally planar tab portion 28 with a rivet hole 30 formed therein. The tab body 28 may also have formed therein adjacent the rivet hole 30 a lance or cut line 32 which will define a mounting ear 34 which permits pivoting of the tab 18 relative to the container wall 12.

The customary pull tab, which is formed of a sheet metal such as steel or aluminum, is reinforced by a peripheral flange or hem. As is clearly shown in FIGS. 1 and 2, the nose portion 24 is reinforced by a peripheral hem 36 of a generally inverted U or V shaped cross section. The free outer edge of the hem 36 is initially spaced from the container wall 12.

Figure 4:
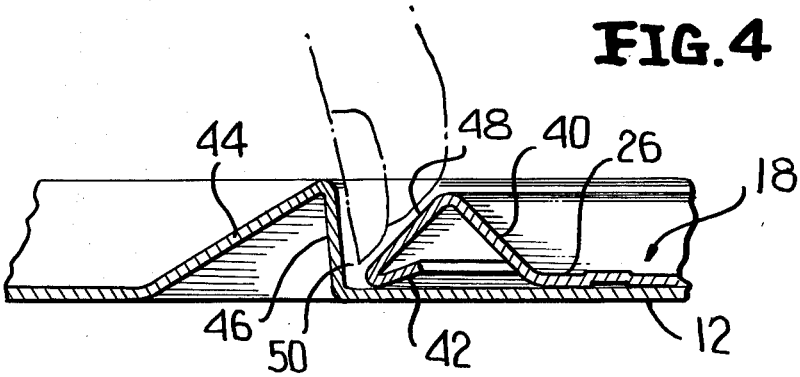
FIG. 4 is an enlarged fragmentary vertical sectional view taken through the lift portion of the tab and the adjacent container panel portion, and most specifically shows the details of the container panel rib and the pull tab hem.
Figure 3:
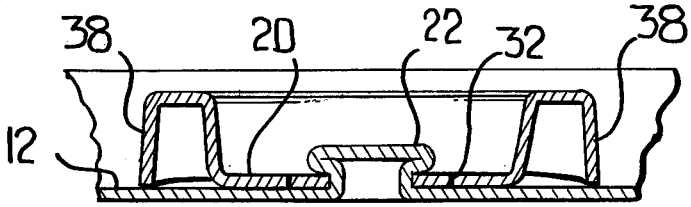
FIG. 3 is a fragmentary vertical sectional view taken generally along the line 3—3 of FIG. 1, and further shows the cross section of the pull tab.

The hem, in modified cross section, also extends alongside the intermediate securing portion 20 and around the lift portion 26. The hem alongside the intermediate securing portion 20 is of a generally inverted V shape, as shown in FIG. 3, and is identified by the numeral 38. It is to be understood that the free edge of the hem 38 is disposed outermost and lowermost and is disposed either in touching engagement with the container wall 12 or is disposed closely adjacent thereto. Further, as the hem 38 progresses rearwardly, the cross section thereof gradually changes so as to be generally triangular and to have the free edge thereof inwardly directed, as shown in FIG. 4. The hem portion which extends about the lift portion 26 is identified by the numeral 40 and the inturned free edge flange is identified by the numeral 42. The flange 42 is also either in touching engagement or is disposed closely adjacent the container wall 12, as is clearly shown in FIG. 4.

It will be seen that the configurations of the hem portions of the pull tab 18 are such that it is difficult for one to insert one's finger beneath the tab to effect the initial lifting thereof so that one may properly engage the lift portion to effect pivoting of the tab in the manner required for the nose portion 24 to stress the container wall 12 along the score line 14 to effect rupture.

Accordingly, the tab configuration alone will provide for certain child resistance.

Figure 2:
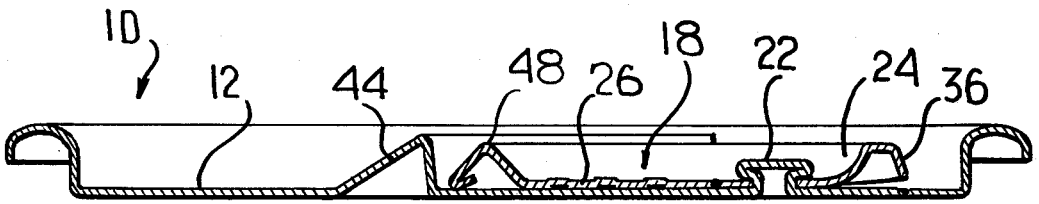
FIG. 2 is a vertical sectional view taken along the line 2—2 of FIG. 1, and shows specifically the cross sections of the end unit and pull tab.

Another feature of the invention, however, resides in the container wall 12 being provided with an upstanding rib 44 which is generally U-shaped in outline and which extends around the lift portion 26 in closely spaced relation as is clearly shown in FIGS. 1 and 4. The rib 44 terminates approximately at the intersection between the lift portion 26 and the securing portion 20 and, as is best shown in FIG. 4, includes a substantially vertical but slightly sloping wall 46 adjacent the pull tab 18. The wall 46, together with an adjacent wall 48 of the hem portion 40, defines a tapered opening 50 into which one's fingernail may be inserted to effect the initial lifting of the lift portion 26, but which opening makes it extremely difficult for a small child to insert his finger with sufficient rigidity and strength to effect the lifting of the lift portion 26. Accordingly, the provision of the rib 44 greatly enhances the child resistant feature of the tab so that the combination makes it possible to make the tab resistant to children of a more advanced age than would be possible with the tab construction per se.

At this time it is pointed out that the cross sectional configurations of the hem portions may be slightly varied as is required for the suitable tooling without departing from the basic concept of the invention.

Most particularly, only a preferred embodiment of the tab and the adjacent container wall him have been illustrated, it being understood that minor variations may be made in the tab and rib assembly without departing from the spirit and scope of the invention as defined by the appended claims.

I claim:

1. A child resistant easy opening container comprising a container panel and a pull tab, said container panel having an outer surface, said pull tab including a tab body having an intermediate securing portion attached to said container panel, and a nose portion and lift portion at opposite ends thereof, said tab body having an underside lying in a general plane substantially coplanar with a major portion of said container panel outer surface, a peripheral hem around said tab body at least generally from said securing portion and around said lift portion, said hem having an outer lower edge substantially continuously touching said container panel outer surface and defining means for resisting initial lifting of said lift portion to actuate said pull tab.

2. The container of claim 1 wherein said hem is of a generally inverted V-shaped cross section.

3. The container of claim 1 wherein said hem is of a generally inverted V-shaped cross section and has an inturned free edge at least along that part thereof remote from said nose portion.

4. The container of claim 1 wherein an upstanding rib is formed in said panel closely surrounding said lift portion to restrict access to said hem outer lower edge.

5. The container of claim 4 wherein said rib and said hem have adjacent upstanding walls.

6. The container of claim 5 wherein said rib and said hem have adjacent upstanding walls converging toward said general plane.

7. The container of claim 1 wherein said rib terminates generally in transverse alignment with the center of said securing portion.

8. The container of claim 1 wherein said securing portion has a rivet extending therethrough, and said rib terminates generally in transverse alignment with the center of said rivet.

* * * * *